US011827471B2

(12) United States Patent
Fukushima

(10) Patent No.: US 11,827,471 B2
(45) Date of Patent: Nov. 28, 2023

(54) SHEET FEEDING DEVICE AND IMAGE FORMING APPARATUS

(71) Applicant: Yasuhide Fukushima, Tokyo (JP)

(72) Inventor: Yasuhide Fukushima, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 72 days.

(21) Appl. No.: 17/476,725

(22) Filed: Sep. 16, 2021

(65) Prior Publication Data

US 2022/0119212 A1 Apr. 21, 2022

(30) Foreign Application Priority Data

Oct. 19, 2020 (JP) ..... 2020-175391
Jan. 26, 2021 (JP) ..... 2021-010595

(51) Int. Cl.
*B65H 1/04* (2006.01)
*B65H 1/12* (2006.01)
*B65H 3/06* (2006.01)

(52) U.S. Cl.
CPC ..... *B65H 1/04* (2013.01); *B65H 1/12* (2013.01); *B65H 3/0661* (2013.01); *B65H 2301/44324* (2013.01); *B65H 2405/1111* (2013.01); *B65H 2405/1117* (2013.01); *B65H 2405/1124* (2013.01); *B65H 2511/11* (2013.01); *B65H 2511/15* (2013.01); *B65H 2801/06* (2013.01)

(58) Field of Classification Search
CPC ... B65H 1/04; B65H 1/12; B65H 1/18; B65H 1/20; B65H 2405/11; B65H 2405/1117; B65H 2405/112; B65H 2405/1124; B65H 2511/11; B65H 2511/15; B65H 2511/21; B65H 2511/212; B65H 2511/214; B65H 2511/216
See application file for complete search history.

(56) References Cited

U.S. PATENT DOCUMENTS

2004/0135306 A1 7/2004 Takahashi
2010/0221051 A1* 9/2010 Yamazaki ..... B65H 1/04 271/18
2015/0203311 A1* 7/2015 Matsumoto ..... B65H 9/06 271/241
2017/0313528 A1* 11/2017 Yang ..... B65H 9/04
2021/0070565 A1* 3/2021 Yamamoto ..... B65H 3/0661
2021/0214176 A1 7/2021 Fukushima et al.
2021/0221636 A1 7/2021 Wakabayashi et al.

FOREIGN PATENT DOCUMENTS

JP 2001048357 A * 2/2001 ..... B65H 1/12
JP 2004-142892 5/2004
JP 2010-202378 9/2010

* cited by examiner

*Primary Examiner* — Prasad V Gokhale
(74) *Attorney, Agent, or Firm* — Harness, Dickey & Pierce, P.L.C.

(57) ABSTRACT

A sheet feeding device includes a storage, a discharger, an angle adjuster, and an urging body. The storage stores a sheet bundle. The discharger contacts and discharge an uppermost sheet of the sheet bundle from the storage in a sheet conveying direction in which the uppermost sheet is conveyed. The angle adjuster changes an angle according to a remaining amount of the sheet bundle in the storage. The urging body urges a trailing end of the uppermost sheet in the sheet conveying direction toward the discharger in stages according to the remaining amount.

20 Claims, 7 Drawing Sheets

A — A

SHEET FEEDING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2020-175391, filed on Oct. 19, 2020, and 2021-010595, filed on Jan. 26, 2021, in the Japan Patent Office, the entire disclosure of each of which is hereby incorporated by reference herein.

BACKGROUND

Technical Field

Embodiments of the present disclosure relate to a sheet feeding device and an image forming apparatus.

Related Art

There is known a sheet feeding device that feeds or supplies a recording medium to an image forming apparatus that forms an image on a sheet-like recording medium. There are various types of sheet feeding devices. In general, a sheet feeding device includes a storage space to store, as a sheet bundle, a plurality of sheets as recording media. The sheet feeding device also includes an assembly to discharge or send out a single sheet from one end of the storage space. A sheet feeding device applied to a small-sized image forming apparatus is often disposed on a bottom face portion of the image forming apparatus.

As an example of the assembly that discharges a sheet from the storage space of a sheet feeding device, there is known an assembly including a discharge roller that rotates in contact with an uppermost sheet located at the uppermost position of the sheet bundle to discharge the sheet in a given direction of conveyance.

SUMMARY

In one embodiment of the present disclosure, a novel sheet feeding device includes a storage, a discharger, an angle adjuster, and an urging body. The storage stores a sheet bundle. The discharger contacts and discharge an uppermost sheet of the sheet bundle from the storage in a sheet conveying direction in which the uppermost sheet is conveyed. The angle adjuster changes an angle according to a remaining amount of the sheet bundle in the storage. The urging body urges a trailing end of the uppermost sheet in the sheet conveying direction toward the discharger in stages according to the remaining amount.

Also described is a novel image forming apparatus incorporating the sheet feeding device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
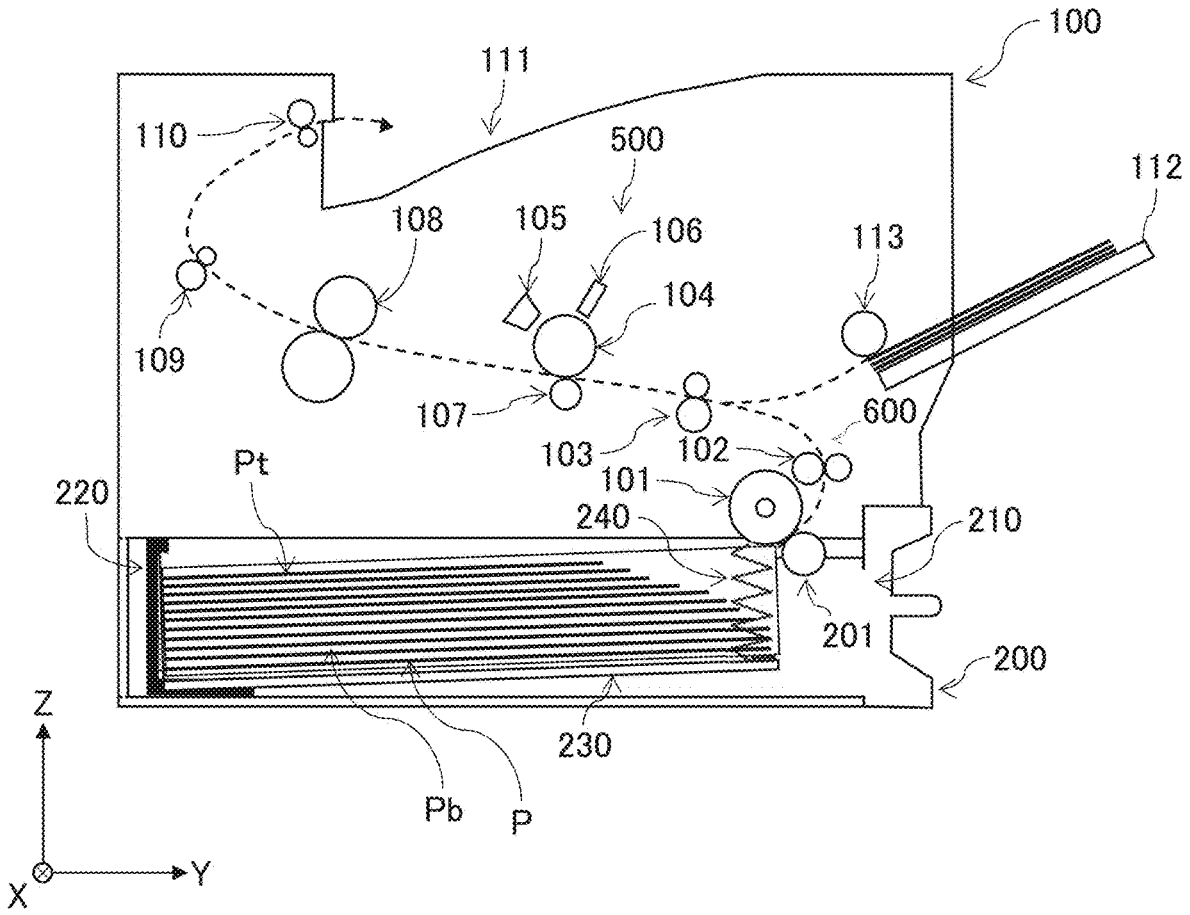
FIG. 1 is a schematic diagram illustrating an internal configuration of a printer serving as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. As used herein, the singular forms "a," "an," and "the" are intended to include the plural forms as well, unless the context clearly indicates otherwise.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

Referring to the drawings, wherein like reference numerals designate identical or corresponding parts throughout the several views, embodiments of the present disclosure are described below.

According to an embodiment of the present disclosure, when the thickness of a sheet bundle stacked in a sheet feeding device decreases as sheets are discharged sequentially from an uppermost sheet of the sheet bundle, the sheet feeding device prevents a discharge failure resulting from a change in relative positions of the sheet bundle and a discharge assembly that discharges the sheets. Specifically, according to the decreasing tendency of the thickness of the sheet bundle, the sheet feeding device displaces the sheet bundle so as to approach the discharge assembly that contacts and discharges the uppermost sheet of the sheet bundle.

In other words, the sheet feeding device presses and supports the sheet bundle so as to prevent displacement of the uppermost sheet in a direction away from the discharge assembly due to a decrease in the remaining amount of the sheet bundle and keep given relative positions of the uppermost sheet and the discharge assembly.

For example, in the case of a sheet feeding device that lifts up, in response to a decrease in the remaining amount of the sheet bundle, one end portion of the bottom of the storage space proximate to the discharge assembly toward the discharge assembly such that the uppermost sheet comes in contact with the discharge assembly, the one end portion of the bottom of the storage space is further lifted up as the sheet bundle decreases. As the inclination of the bottom of the storage space increases, the inclination of the sheet bundle increases, resulting in an increase in the force for moving the sheet bundle in the direction away from the discharge assembly. To address such a situation, in the embodiments described below, the sheet feeding device urges the entire sheet bundle toward the discharge assembly against the force for moving the sheet bundle away from the discharge assembly among forces applied to the sheet bundle due to the inclination of the bottom of the storage space.

In order to keep the relative positions of the uppermost sheet and the discharge assembly while the inclination of the bottom portion of the storage space increases due to a decrease in the remaining amount of the sheet bundle, the entire sheet bundle is to be pressed in an increased amount in a sheet conveying direction in which the sheets are discharged or conveyed. In the embodiments described below, according to the remaining amount of the sheet bundle, the sheet feeding device changes the amount by which the entire sheet bundle is pressed out.

Specifically, when the storage space is loaded in full with the sheet bundle, a first support plate provided with a first urging body and a second support plate provided with a second urging body forms an integral thickness. Such a configuration urges the entire sheet bundle in the sheet conveying direction. Such a configuration also prevents the uppermost sheet from moving away from the discharge assembly when the sheet bundle decreases as the sheets are sequentially sent out from the uppermost sheet of the sheet bundle. A leading end or leading end portion of the uppermost sheet in the sheet conveying direction remains at a position of contact between the uppermost sheet and the discharge assembly, even from when the sheet bundle is stacked in half to when the storage space becomes almost empty. In the sheet feeding device, a trailing end or trailing end portion of the sheet bundle in the sheet conveying direction is supported and the leading end portion of the uppermost sheet in the sheet conveying direction remains at a given position such that the discharge assembly contacts the leading end portion of the uppermost sheet in the sheet conveying direction and discharges the uppermost sheet even from when the sheet bundle is stacked in half to when the storage space becomes empty. Accordingly, the feeding device prevents a conveyance failure.

Note that, in the following description, a leading end or a leading end portion may refer to an end leading in the sheet conveying direction, which is a direction in which a sheet (or a sheet P) is conveyed. Similarly, a trailing end or a trailing end portion may refer to an end trailing in the sheet conveying direction.

Referring now to FIG. 1, a description is given of an image forming apparatus according to an embodiment of the present disclosure.

FIG. 1 is a schematic diagram illustrating a configuration of a printer 100 serving as an image forming apparatus according to an embodiment of the present disclosure.

As illustrated in FIG. 1, the printer 100 includes a discharge roller 101, a relay roller 102, a registration roller 103, a photoconductor 104, a charger 105, a light emitting diode (LED) 106, a transfer roller 107, a fixing roller 108, a pre-output roller 109, an output roller 110, an output tray 111, a bypass feeder 112, and a bypass feeding roller 113. The discharge roller 101 serves as a sheet feeding roller or a discharger that feeds and discharges a sheet P.

Below the printer 100 is a sheet feeding device 200 according to an embodiment of the present disclosure. As will be described later, in a case in which the sheet feeding device 200 serves as a sheet feeder of the printer 100, the sheet feeding device 200 is disposed in a lower portion of the printer 100. In short, the sheet feeding device 200 may be a part of the printer 100 or may be separate from the printer 100. The sheet feeding device 200 is a device that feeds the sheet P, which is a sheet-like recording medium, in or to the printer 100. Optionally, a new sheet feeding device 200 may be disposed below the sheet feeding device 200 described above.

The sheet feeding device 200 includes a sheet storage space 210 as an input tray that serves as a storage to store and feed a plurality of sheets P. In other words, the plurality of sheets P is stored in the sheet storage space 210. The plurality of sheets P may be referred to as a sheet bundle Pb in the following description. An uppermost sheet Pt that is located at the uppermost position of the sheet bundle Pb stored in the sheet storage space 210 is urged so that a leading end portion of the uppermost sheet Pt contacts the discharge roller 101 serving as a discharger included in the printer 100. As the discharge roller 101 rotates, the uppermost sheet Pt is pulled out in the Y direction in FIG. 1 by friction between the uppermost sheet Pt and the discharge roller 101. The uppermost sheet Pt then passes between the discharge roller 101 and a separation roller 201 and is conveyed as a single sheet P toward the relay roller 102 of the printer 100. As illustrated in FIG. 1, the relay roller 102 is disposed downstream from the discharge roller 101 and the separation roller 201 in the sheet conveying direction.

The relay roller 102 conveys the sheet P thus fed from the sheet feeding device 200 to a conveyance passage indicated by a dotted arrow in FIG. 1. The registration roller 103 temporarily stops the sheet P sent out from the sheet storage space 210. Activation of the registration roller 103 is timed to resume the conveyance of the sheet P so that a toner image is transferred onto the sheet P. The discharge roller 101, the relay roller 102, the registration roller 103, the pre-output roller 109, and the output roller 110 construct a conveying device 600 that conveys the sheet P to an image forming device 500 including, e.g., the photoconductor 104 and discharges the sheet bearing a transferred image to the outside of the printer 100. The printer 100 includes the bypass feeder 112 and the bypass feeding roller 113 that feeds a sheet P from the bypass feeder 112, as sheet feeders different from the sheet feeding device 200.

The printer 100 includes the charger 105 and the LED 106 around the photoconductor 104. The charger 105 charges the surface of the photoconductor 104. The LED 106 serves as a light source that exposes the charged surface of the photoconductor 104 according to image information to form an electrostatic latent image on the photoconductor 104. The image forming device 500 performs a series of operations to form an image that is to be transferred onto the sheet P.

As described above, activation of the registration roller 103 is timed to convey the sheet P toward a transfer area between the photoconductor 104 and the transfer roller 107 so that the sheet P meets a toner image formed on the photoconductor 104 and that the toner image is transferred from the photoconductor 104 onto the sheet P at the transfer area.

Thereafter, the sheet P is conveyed to the fixing roller 108 that fixes the transferred toner image onto the sheet P. The sheet P bearing the fixed toner image then passes by the pre-output roller 109 and the output roller 110. Finally, the sheet P is discharged onto the output tray 111 atop a housing of the printer 100.

The input tray of the sheet feeding device 200 is a front-loading sheet storage having a structure to slide forward in the X direction in FIG. 1 with respect to a body of the printer 100. Alternatively, the input tray of the sheet feeding device 200 may be a drawer slidable in the Y direction in FIG. 1. The discharge roller 101 may be disposed in the body of the printer 100 or in the sheet feeding device 200. The discharge roller 101 may be drawn out together with the input tray.

In the sheet feeding device 200, a bottom plate 230 is a bottom of the sheet storage space 210. The bottom plate 230 serves as a placement surface on which the sheet bundle Pb is placed. A spring 240 is disposed at a downstream end portion of the bottom plate 230 in the sheet conveying direction. The spring 240 serves as a bottom plate mover that urges and moves an end portion of the bottom plate 230 upward. The sheet feeding device 200 supports an upstream end portion of the bottom plate 230 in the sheet conveying direction, upstream from the center of the sheet bundle Pb and downstream from an end fence 220 in the sheet conveying direction. The spring 240 supports the downstream end portion of the bottom plate 230 in the sheet conveying direction. With such a configuration, the bottom plate 230 rotates about the upstream end portion of the bottom plate 230 in the sheet conveying direction. Specifically, depending on the amount of the sheet bundle Pb placed on the bottom plate 230, the downstream end portion of the bottom plate 230 in the sheet conveying direction is moved vertically in FIG. 1 by the action of an elastic force of the spring 240 as an elastic body.

When the sheet storage space 210 is loaded in full with sheets P, the bottom plate 230 is substantially parallel to the placement surface of the sheet feeding device 200 due to the load of the sheet bundle Pb. At this time, the spring 240 keeps urging upward the downstream end portion of the bottom plate 230 in the sheet conveying direction, to press the leading end portion of the uppermost sheet Pt against the discharge roller 101 in a tangential direction.

Accordingly, the sheet bundle Pb placed in the sheet storage space 210 is sent by the discharge roller 101 downstream in the sheet conveying direction, whereas the separation roller 201 sends out a single sheet P one by one from the sheet bundle Pb to the conveyance passage to feed the sheet P in or to the printer 100.

Figure 2A:
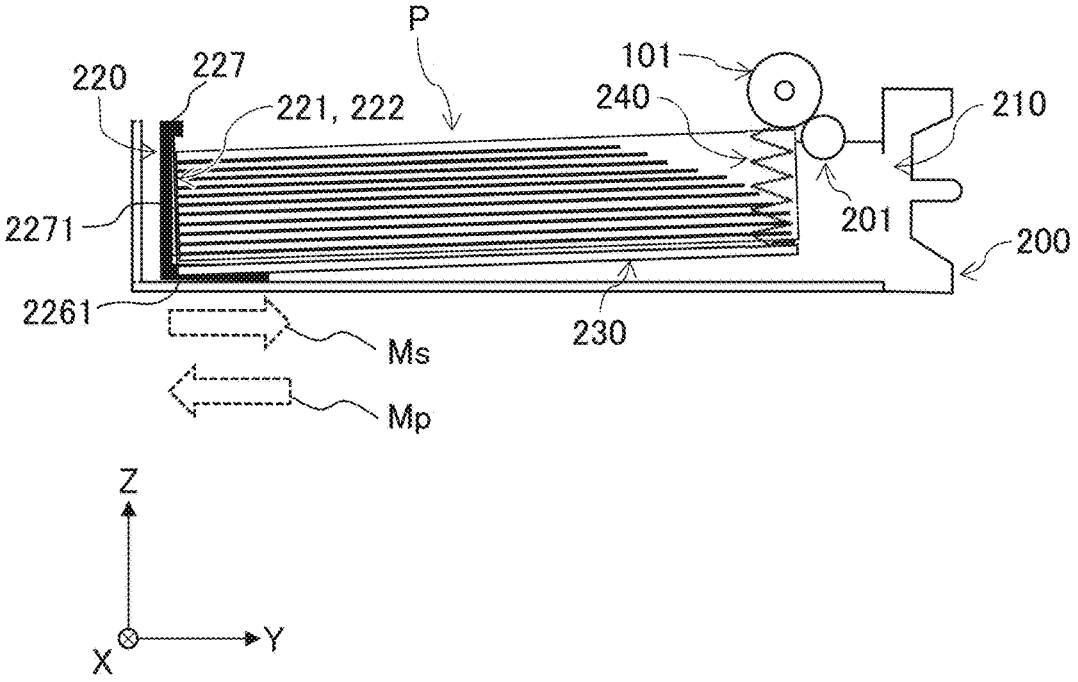
FIG. 2A is a cross-sectional side view of a sheet feeding device loaded in full with sheets, according to a first embodiment of the present disclosure.
Figure 2B:
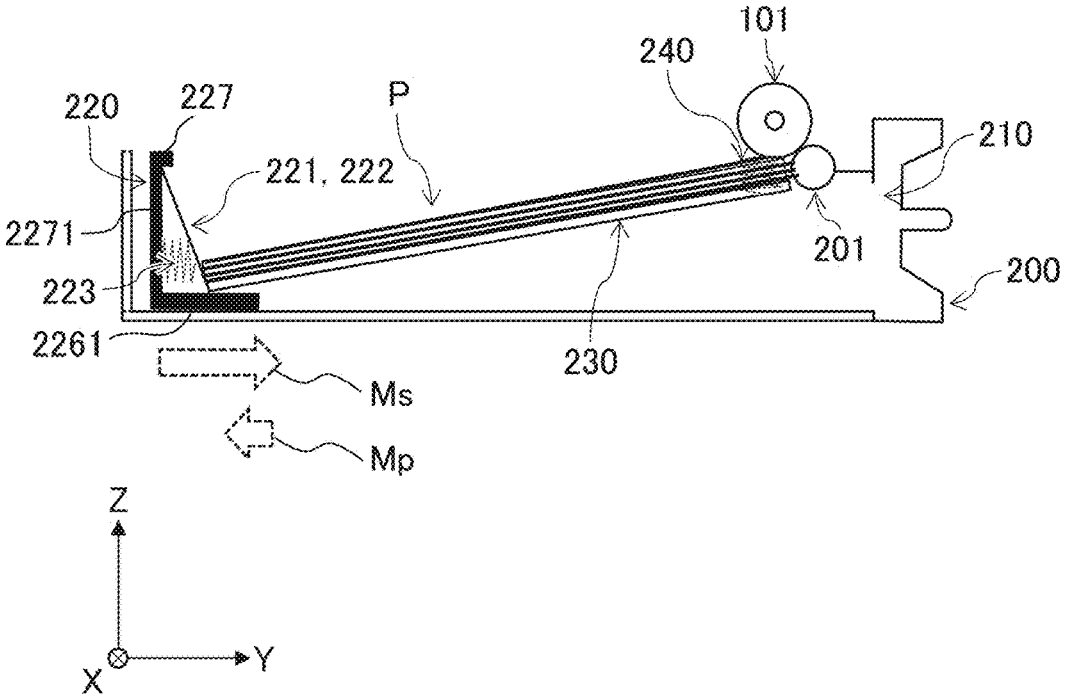
FIG. 2B is a cross-sectional side view of the sheet feeding device of FIG. 2A with few sheets left.

Referring now to FIGS. 2A and 2B, a detailed description is given of the sheet feeding device 200.

Each of FIGS. 2A and 2B is a cross-sectional side view of the sheet feeding device 200.

As illustrated in FIGS. 2A and 2B, the sheet feeding device 200 includes the end fence 220 serving as a support and an urging body that supports a trailing end portion of the sheet bundle Pb at an upstream end portion of the sheet storage space 210 in the sheet conveying direction. The end fence 220 is selectively fixable to a given position in the sheet storage space 210.

The end fence 220 includes a vertically long portion 2271 and a bottom portion 2261 that supports the vertically long portion 2271. The vertically long portion 2271 rotatably holds vertically long support plates (namely, a first support plate 221 and a second support plate 222) that support the trailing end portion of the sheet bundle Pb. The bottom portion 2261, extending in the sheet conveying direction, is fixable at a given position in the sheet storage space 210. The height dimension of the end fence 220 is regulated by the depth of the sheet storage space 210. The height dimension of the end fence 220 regulates the height dimension of the support plates (i.e., the first support plate 221 and the second support plate 222).

The bottom plate 230 is a bottom of the sheet storage space 210 and serves as a sheet support. The bottom plate 230 serves as an angle adjuster that changes the angle of the bottom plate 230 according to the remaining amount of the sheet bundle Pb. The spring 240 lifts up one end portion of the bottom plate 230 to keep the uppermost sheet Pt in contact with the discharge roller 101. Thus, the spring 240 also serves as an angle adjuster together with the bottom plate 230. When the bottom plate 230 is rotated by the spring 240 depending on the remaining amount of the sheet bundle Pb, the position of the leading end of the uppermost sheet Pt relative to the discharge roller 101 is shifted upstream in the sheet conveying direction, thus deviating the angle with respect to the discharge roller 101 from the tangential direction. The end fence 220 adjusts such positional shifting. A detailed description of the adjustment is deferred.

FIG. 2A illustrates an example in which the sheet storage space 210 is loaded with the sheet bundle Pb to a full capacity of the sheet storage space 210. By contrast, FIG. 2B illustrates an example in which the sheet storage space 210 is almost empty after the sheets P are sent out from the sheet bundle Pb. Various sheet feeding ways are known that may be employed by the sheet feeding device 200. In the present embodiment, the sheet feeding device 200 feeds the sheet P with the separation roller 201. Alternatively, the sheet feeding device 200 may employ a separation pad system. In the present embodiment, the sheet feeding device 200 has a configuration to vertically move one end portion of the bottom plate 230 to urge the uppermost sheet Pt to contact the discharge roller 101. The configuration to urge the uppermost sheet Pt of the sheet bundle Pb stored in the sheet storage space 210 in a direction to keep the uppermost sheet Pt in contact with the discharge roller 101 is not limited to the configuration exemplified in the present embodiment. Alternatively, for example, the sheet feeding device 200 may have a configuration to urge one end portion of the bottom plate 230 so as to push the bottom plate 230 upward from below, or a configuration to drive a rotary shaft.

When the sheet storage space 210 is loaded in full or nearly full with the sheets P as illustrated in FIG. 2A, the load of the sheet bundle Pb extends the spring 240 and lowers a leading end portion of the bottom plate 230 (i.e., the downstream end portion of the bottom plate 230 in the sheet conveying direction). As a result, the bottom plate 230 becomes substantially parallel to the ground surface of the input tray. At this time, the spring 240 keeps urging upward the leading end portion of the bottom plate 230, to press the uppermost sheet Pt against the discharge roller 101 at a position of contact between the uppermost sheet Pt and the discharge roller 101.

Even when the sheet storage space 210 is loaded in full or nearly full with the sheets P as illustrated in FIG. 2A, the bottom plate 230 is slightly inclined. Although such an inclination of the bottom plate 230 applies the load to the trailing end of the sheet bundle Pb, the end fence 220 supports and keeps the sheet bundle Pb at a given position. At this time, the first support plate 221 and the second support plate 222, each serving as a support provided with an urging body, are pressed toward the rearmost end by a trailing end pressure contact force Mp generated by the load of the sheet bundle Pb as a force applied to the end fence 220 by the sheet bundle Pb. The supports urge the trailing end of the sheet bundle Pb in the sheet conveying direction, to prevent the leading end of the uppermost sheet Pt (i.e., a downstream end of the uppermost sheet Pt in the sheet conveying direction) from being shifted backward in the sheet conveying direction.

As the sheets P are sent out one by one and the sheet storage space 210 becomes nearly empty with a decreased amount of the sheet bundle Pb, the load on the bottom plate 230 is reduced. In this case, as illustrated in FIG. 2B, the elastic force of the spring 240 serving as an angle adjuster raises the leading end portion of the bottom plate 230 and keeps the uppermost sheet Pt pressed against the discharge roller 101.

In the state illustrated in FIG. 2B, the inclination of the bottom plate 230 is sharply increased. Such a sharply increased inclination of the bottom plate 230 increases the force for moving the sheet bundle Pb toward a trailing end portion of the bottom plate 230. On the other hand, as the sheet bundle Pb decreases, the trailing end pressure contact force Mp gets weaker. Whereas an urging force Ms relatively exceeds the trailing end pressure contact force Mp. The first support plate 221 serving as a first support is moved in the sheet conveying direction by the urging force of a first elastic body 223 serving as a first urging body included in the end fence 220, to press and support the position of the trailing end of the sheet bundle Pb. As will be described later, the second support plate 222 serving as a second support of the end fence 220 is also urged in the sheet conveying direction. The second support plate 222 is moved in the sheet conveying direction by the urging force of a second elastic body 224 serving as a second urging body, to press and support the position of the trailing end of the sheet bundle Pb. Accordingly, the leading end of the uppermost sheet Pt keeps reaching the position of contact between the uppermost sheet Pt and the discharge roller 101.

Now, a description is given of a first embodiment.

Specifically, with reference to FIGS. 3A to 5B, a detailed description is given of the end fence 220 according to the first embodiment of the present disclosure.

As described above, the end fence 220, serving as a trailing end regulator that regulates the trailing end of sheets at an upstream position in the sheet conveying direction, supports the trailing end portion of the sheet bundle Pb (i.e., the plurality of sheets P) placed in the sheet storage space 210 of the sheet feeding device 200. Regardless of the amount of the sheet bundle Pb (i.e., the plurality of sheets P), the end fence 220 keeps the position at which the uppermost sheet Pt contacts the discharge roller 101.

Figure 3A:
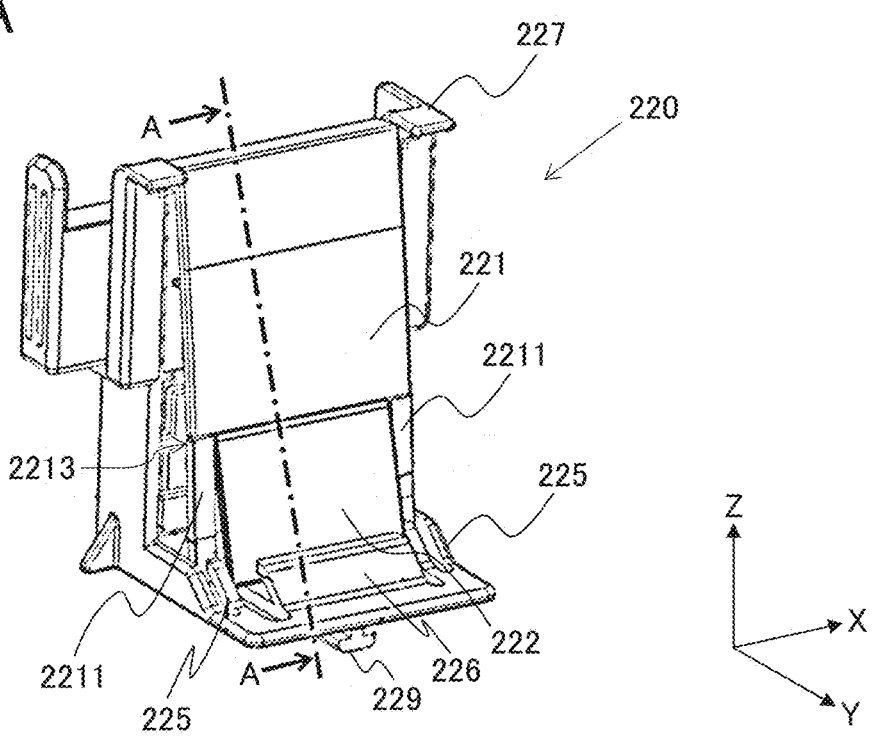
FIG. 3A is a perspective view of an end fence of the sheet feeding device of FIG. 2A with few sheets left.
Figure 3B:
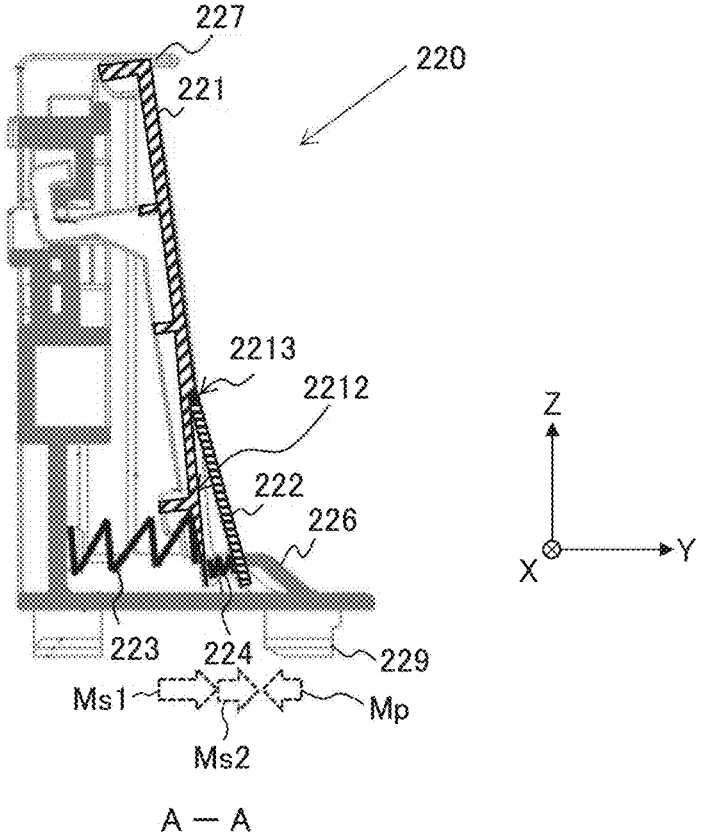
FIG. 3B is a cross-sectional view of the end fence along an A-A line illustrated in FIG. 3A.
Figure 4A:
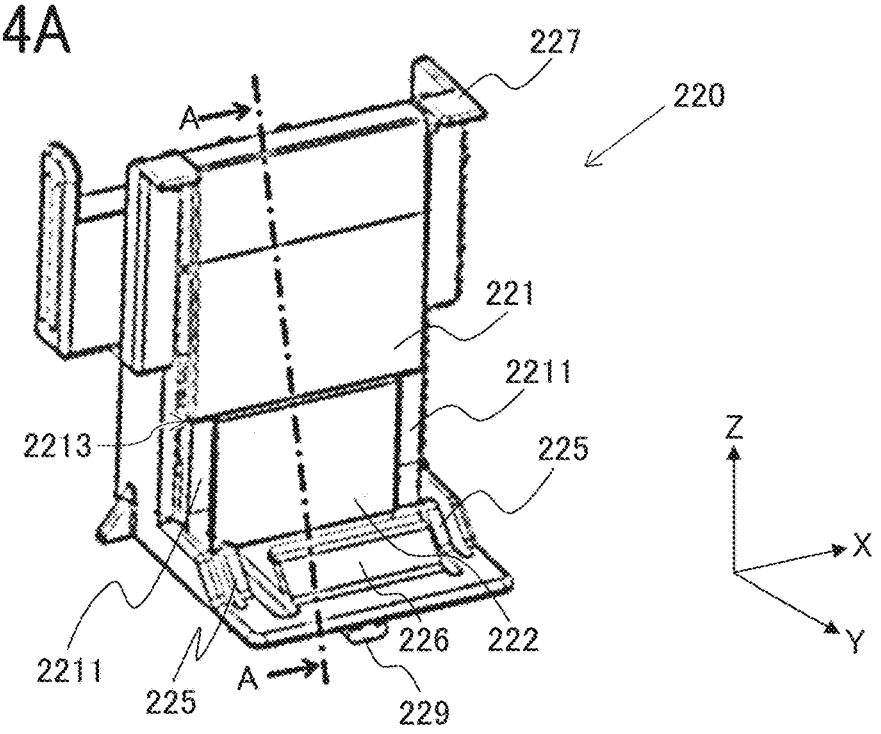
FIG. 4A is a perspective view of the end fence of FIG. 3A with sheets stacked in full.
Figure 4B:
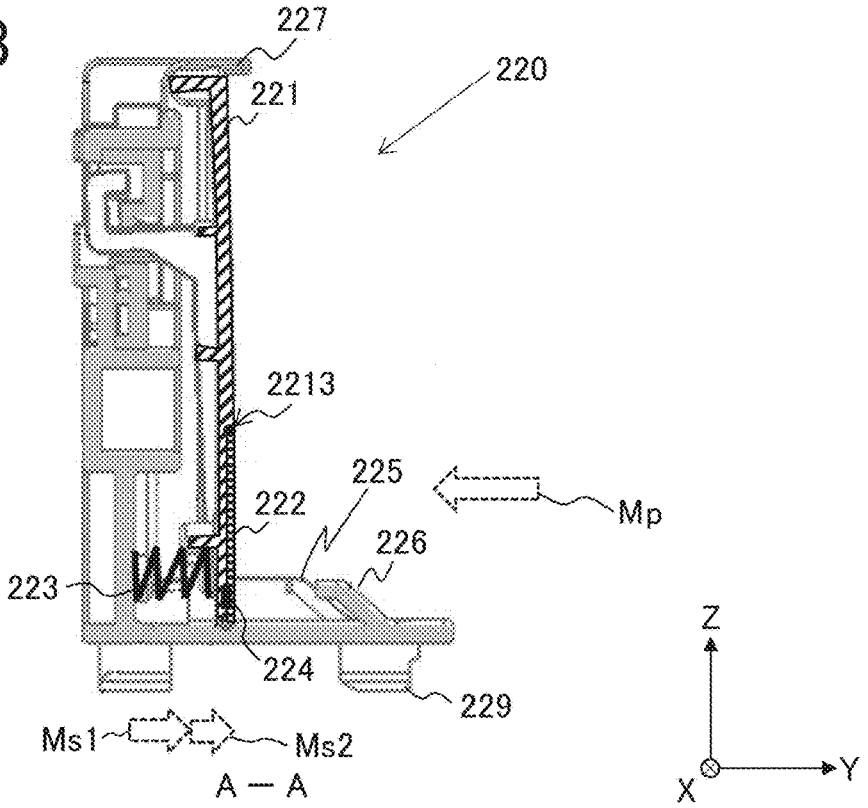
FIG. 4B is a cross-sectional of the end fence along an A-A line illustrated in FIG. 4A.
Figure 5A:
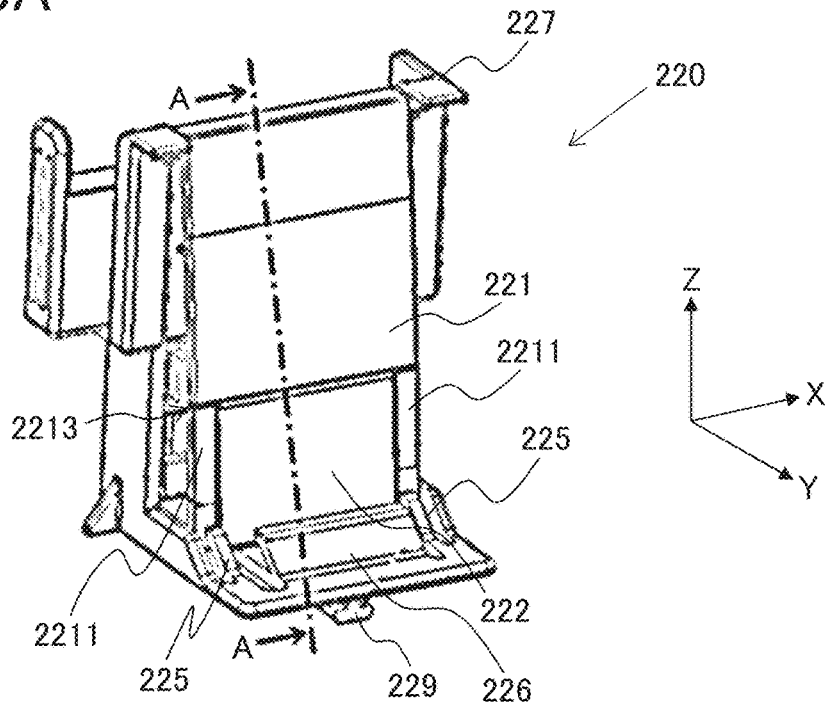
FIG. 5A is a perspective view of the end fence of FIG. 3A with sheets stacked in half.
Figure 5B:
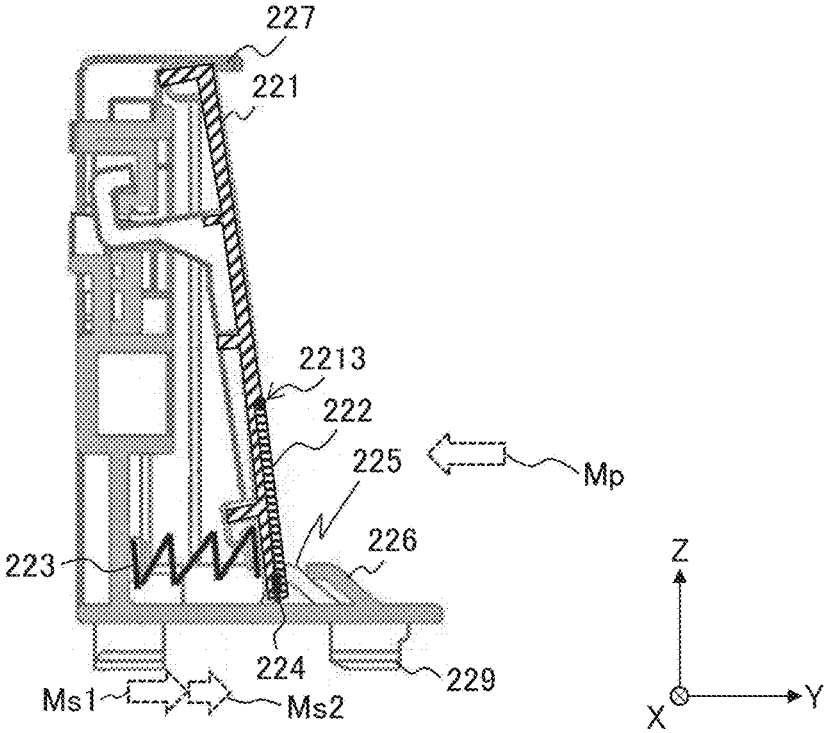
FIG. 5B is a cross-sectional of the end fence along an A-A line illustrated in FIG. 5A.

FIGS. 3A and 3B illustrate the end fence 220 when the sheet storage space 210 is nearly empty with a decreased amount of the sheet bundle Pb. FIGS. 4A and 4B illustrate the end fence 220 when the sheet storage space 210 is loaded in full with the sheet bundle Pb. FIGS. 5A and 5B illustrate the end fence 220 when the sheet storage space 210 is loaded in half with the sheet bundle Pb, in other words, when the remaining amount of the sheet bundle Pb is around half between full and empty.

The end fence 220 is engaged with the sheet feeding device 200. Specifically, the end fence 220 is disposed proximate to a trailing end of the sheet storage space 210. The position of the end fence 220 is changeable relative to the bottom plate 230 according to the size of the sheet P. The end fence 220 engaged with the sheet feeding device 200 presses and supports the trailing end of the sheet bundle Pb. Such a configuration allows the end fence 220 to prevent the leading end portion of the sheet bundle Pb from being shifted backward in the sheet conveying direction when the inclination of the bottom plate 230 increases sharply as the sheets P are continuously sent out and the remaining amount of the sheet bundle Pb decreases.

Referring now to FIGS. 3A and 3B, a description is given of a configuration of the end fence 220 according to the first embodiment of the present disclosure.

The end fence 220 includes the first support plate 221 serving as the first support and the second support plate 222 serving as the second support. The first support plate 221 and the second support plate 222 are end supports. The first support plate 221 has a first end portion (e.g., upper end portion) fixed to an upper end portion of an end fence body 227 and a second end portion (e.g., lower end portion) rotatable about the first end portion. Thus, the first support plate 221 is supported by the end fence body 227. The second support 222 has a first end portion fixed around a middle portion of the first support plate 221, below halfway between the first end portion and the second end portion of the first support plate 221. The second support 222 has a second end portion rotatable about the first end portion. Thus, the second support plate 222 is supported by the first support plate 221.

The first support plate 221 is a rectangular plate having a short dimension substantially the same as the height dimension of the end fence 220. The first support plate 221 includes a groove portion 2213 slightly below a vertical center along the length of the first support plate 221. Below the groove portion 2213 as a vertical boundary of the first support plate 221, the first support plate 221 includes a thin plate portion 2212 and side end portions 2211. The thin plate portion 2212 has a thickness different from the thickness of an upper portion of the first support plate 221 above the groove portion 2213. The side end portions 2211 have a thickness substantially the same as the thickness of the upper portion of the first support plate 221 above the groove portion 2213. The side end portions 2211 are located beside the thin plate portion 2212 in a width direction of the thin plate portion 2212.

The second support plate 222 has one end portion rotatably engaged with the groove portion 2213 of the first support plate 221. The second support plate 222 is a plate thinner than the first support plate 221. A combination in thickness of the second support plate 222 and the thin plate portion 2212 of the first support plate 221 is substantially the same as the thickness of the first support plate 221.

When the sheet bundle Pb is stacked in full, the bottom plate 230 is substantially flat and the trailing end of the sheet bundle Pb is proximate to the end fence body 227. In this state, the second support plate 222 is accommodated in a position sandwiched between the side end portions 2211 of the first support plate 221. Thus, the sheet storage space 210 is loaded in full with the sheet bundle Pb.

FIG. 3B is a cross-sectional view of the end fence 220 along an A-A line illustrated in FIG. 3A. As illustrated in FIG. 3B, the first elastic body 223 serving as the first urging body is disposed at a lower end or lower end portion of the first support plate 221. The first elastic body 223 has a first end portion attached to the end fence body 227 and a second end portion attached to the lower end portion of the first support plate 221 in FIG. 3B. The elastic force of the first elastic body 223 urges the first support plate 221 in the Y direction in FIG. 3B. In other words, the first support plate 221 urges the sheet bundle Pb toward the discharge roller 101 to press and support the sheet bundle Pb so that the uppermost sheet Pt reaches the position at which the uppermost sheet Pt contacts the discharge roller 101. The first elastic body 223 is, e.g., a spring. Although the first elastic body 223 is described as a spring in the present embodiment, the first elastic body 223 may be an elastic body other than the spring, provided that the first elastic body 223 urges the first support plate 221 serving as the first support in a given direction.

The second elastic body 224 serving as the second urging body is disposed at a lower end or lower end portion of the second support plate 222 in FIG. 3B. The second elastic body 224 has a first end portion attached to the first support plate 221 and a second end portion attached to the lower end portion of the second support plate 222 in FIG. 3B. The elastic force of the second elastic body 224 urges the second support plate 222 in the Y direction in FIG. 3B. In other words, the second support plate 222 presses and supports the sheet bundle Pb toward the discharge roller 101 to move, in the sheet conveying direction, and support the position of the trailing end of the sheet bundle Pb that remains by a decreased amount. Thus, the second support plate 222 keeps the position of the leading end portion of the uppermost sheet Pt at the position of contact between the uppermost sheet Pt and the discharge roller 101. The second elastic body 224 is, e.g., a spring. Although the second elastic body 224 is described as a spring in the present embodiment, the second elastic body 224 may be an elastic body other than the spring, provided that the second elastic body 224 urges the second support plate 222 serving as the second support in a given direction.

The end fence body 227 includes a rail portion 229 that allows the end fence body 227 to move relative to the bottom plate 230 in the sheet conveying direction. The rail portion 229 is slidably fitted into a rail groove of the sheet feeding device 200. The rail groove is formed along the sheet conveying direction. Such a configuration allows the end fence 220 to move the first support plate 221 and the second support plate 222 to a given position along the rail groove according to the size of the sheet P and support the trailing end of the sheet P in the sheet conveying direction at the given position.

In addition, first stoppers 225 and a second stopper 226 serving as restrictors that restrict the moving ranges of the urging bodies are disposed at the bottom of the end fence body 227. As illustrated in FIG. 3A, the two first stoppers 225 are disposed in the width direction of the sheet P to restrict the moving range of the first support plate 221 in the Y direction. The first stoppers 225 are inclined bodies rising from the bottom of the end fence body 227 and having an inclined portion.

The first stoppers 225 are located to contact the side end portions 2211 of the first support plate 221 that is urged by the first elastic body 223 and rotated to a given position. The side end portions 2211 contact the first stoppers 225 to restrict the rotation of the first support plate 221. The first stoppers 225 have a given height dimension to contact a portion above the lower end portion of the side end portion 2211.

The first stoppers 225 restrict the first support plate 221 urged by the first elastic body 223 so as not to move excessively in the Y direction in FIGS. 3A and 3B. Without the first stoppers 225, the first support plate 221 is free to move in the Y direction by an amount by which the first elastic body 223 extends when the sheet bundle Pb runs out. In this case, when the sheet storage space 210 is replenished with new sheet bundle Pb, a part of the sheet bundle Pb may enter a gap formed between the first support plate 221 and the bottom plate 230. As a result, the sheet bundle Pb may not be urged as appropriate by the first support plate 221. To prevent such a situation, each of the first stoppers 225 is disposed such that the tip of the first stopper 225 is located at a given position to restrict the movement of the lower end portion of the first support plate 221 that is rotated.

At the bottom of the end fence body 227, the second stopper 226 is disposed between the two first stoppers 225 that are disposed in the width direction of the sheet P, to restrict the moving range of the second support plate 222 in the Y direction in FIGS. 3A and 3B. The second stopper 226 is an inclined body rising from the bottom of the end fence body 227 and having an inclined portion. The second stopper 226 is disposed such that a portion of the second stopper 226 that contacts the second support plate 222 is located downstream in the sheet conveying direction from a portion of the first stopper 225 that contacts the first support plate 221, to restrict the second support plate 222 moved in the Y direction by the elastic force of the second elastic body 224 after the side end portions 2211 of the first support plate 221 rotated to the given position contact the first stoppers 225 and restrict the movement of the first support plate in the Y direction in FIGS. 3A and 3B. The second stopper 226 has a given height dimension to contact a portion above the lower end portion of the second support plate 222.

Like the first stoppers 225, the second stopper 226 is in an inclined shape, rising from the bottom of the end fence body 227 and having an inclined portion. As the trailing end of the sheet bundle Pb is placed on the inclined portion of the second stopper 226, the second stopper 226 prevents a lowermost sheet P located at the lowermost position of the sheet bundle Pb from entering the gap between the bottom plate 230 and the lower ends of the first support plate 221 and the second support plate 222.

Now, a description is given of an operation of the end fence 220. When the sheet storage space 210 is loaded in full with the sheet bundle Pb as illustrated in FIGS. 4A and 4B, the inclination of the bottom plate 230 is in the gentlest state as illustrated in FIG. 2A. In this state, the spring 240 urges upward the leading end portion of the bottom plate 230 to keep the uppermost sheet Pt pressed against the discharge roller 101. At this time, since a relatively large load of the sheet bundle Pb is applied to the end fence 220 supporting the trailing end of the sheet bundle Pb, the trailing end pressure contact force Mp is greater than an urging force Ms2 of the second elastic, body 224 urging the second support plate 222. Accordingly, the second support plate 222 contacts with the thin plate portion 2212 of the first support plate 221, thus appearing as an integrated part of the first support plate 221.

When the sheet storage space 210 is loaded in full with the sheet bundle Pb, the trailing end pressure contact force Mp is greater than an urging force Ms1 of the first elastic body 223 urging the fully loaded first support plate 221. Accordingly, the lower end portion of the first support plate 221 remains at a position closest to the back side of the end fence body 227.

Even when the sheet bundle Pb is loaded in full, the urging force Ms1 as an elastic force of the first elastic body 223 causes the first support plate 221 to keep urging the sheet bundle Pb toward the discharge roller 101. Similarly, the urging force Ms2 as an elastic force of the second elastic body 224 causes the second support plate 222 to keep urging the sheet bundle Pb toward the discharge roller 101.

When the remaining amount of the sheet bundle Pb decreases from the state illustrated in FIGS. 4A and 4B, the trailing end pressure contact force Mp decreases. As a result, first, the first support plate 221 is moved in the Y direction in FIGS. 4A and 4B to a state illustrated in FIGS. 5A and 5B by the urging force Ms1 as an elastic force of the first elastic body 223 exerting a first urging force greater than the urging force Ms2 as an elastic force of the second elastic body 224 exerting a second urging force.

Specifically, as illustrated in FIGS. 5A and SB, the first support plate 221 reaches a position at which the first stoppers 225 restrict the movement of the first support plate 221. In this state, the sheet bundle Pb remains by an amount slightly reduced from about a half of fully stacked amount of the sheet bundle Pb. At this time, the inclination of the bottom plate 230 is also moderate.

As the sheets P are further conveyed from the state illustrated in FIGS. 5A and 5B and the sheet bundle Pb is reduced, the trailing end pressure contact force Mp decreases. On the other hand, the inclination of the bottom plate 230 increases sharply. Accordingly, the momentum of the sheet bundle Pb sliding down toward the end fence 220 increases. In this state, the urging force Ms2 as an elastic force of the second elastic body 224 exerting the second urging force allows the second support plate 222 to move in the Y direction in FIGS. 5A and 5B. Such a state is illustrated in FIGS. 3A and 3B. In other words, in the state illustrated in FIGS. 3A and 3B, the second urging force acts against the trailing end pressure contact force Mp to prevent the sheet bundle Pb from slipping backward in the sheet conveying direction. Accordingly, the leading end portion (i.e., downstream end portion) of the uppermost sheet Pt in the sheet conveying direction remains at an appropriate position of contact between the uppermost sheet Pt and the discharge roller 101. Although the inclination of the bottom plate 230 is relatively large, the position of contact between the leading end portion (i.e., downstream end portion) of the uppermost sheet Pt in the sheet conveying direction and the discharge roller 101 is shifted downstream in the sheet conveying direction. Accordingly, the uppermost sheet Pt contacts the discharge roller 101 in the tangential direction as in a case in which the sheet bundle Pt is stacked in full.

As described above, the end fence 220 according to the first embodiment includes the first support plate 221 and the second support plate 222 to urge the sheet bundle Pb in the sheet conveying direction while changing the urging forces in stages, specifically, with two elastic bodies and then with a single elastic body, according to the remaining amount of the sheet bundle Pb in the sheet storage space 210. Specifically, in such a configuration, the first urging force mainly urges the sheet bundle Pb that remains by a relatively large amount to regulate the trailing end of the sheet bundle Pb at a given position until the remaining amount of the sheet bundle Pb decreases and the inclination of the bottom plate 230 increases. When the remaining amount of the sheet bundle Pb decreases and the inclination of the bottom plate 230 increases, the second urging force urges the sheet bundle Pb that remains by a relatively small amount to regulate the trailing end of the sheet bundle Pb at a given position.

In other words, even in a case in which the height dimension of the first support plate 221 is reduced to downsize the end fence 220 without increasing the moving amount of the first support plate 221 exerting the first urging force, the first support plate 221 cooperates with the second support plate 222 to regulate the trailing end of the sheet bundle Pb.

According to the first embodiment, even in a case in which the height dimension of the first support plate 221 is reduced (i.e., even in a case in which the end fence 220 is lowered), the end fence 220 keeps the uppermost sheet Pt pressed against the discharge roller 101.

In other words, even in a case in which the sheet feeding device 200 is made thin or downsized, the uppermost sheet Pt remains in contact with the discharge roller 101 as appropriate from when the sheet bundle Pb is stacked in full until when the last or lowermost sheet P of the sheet bundle Pb is sent out. In short, even a downsized sheet feeding device 200 prevents a discharge failure.

Now, a description is given of a second embodiment of the present disclosure.

Specifically, with reference to FIGS. 6A to 7B, a detailed description is given of an end fence 220*a* according to the second embodiment of the present disclosure.

Figure 6A:
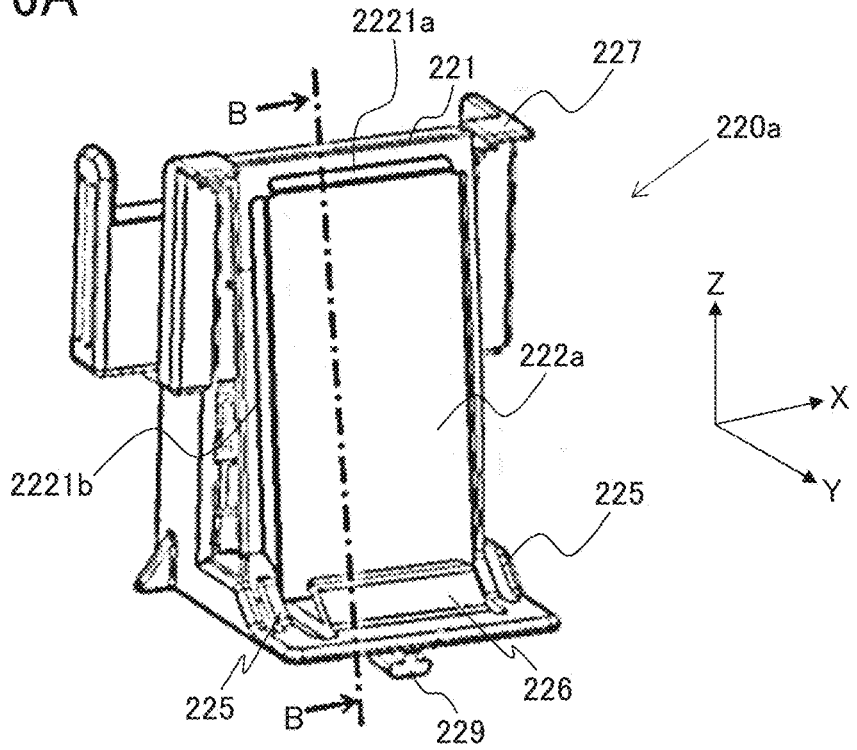
FIG. 6A is a perspective view of an end fence of a sheet feeding device with few sheets left, according to a second embodiment of the present disclosure.
Figure 6B:
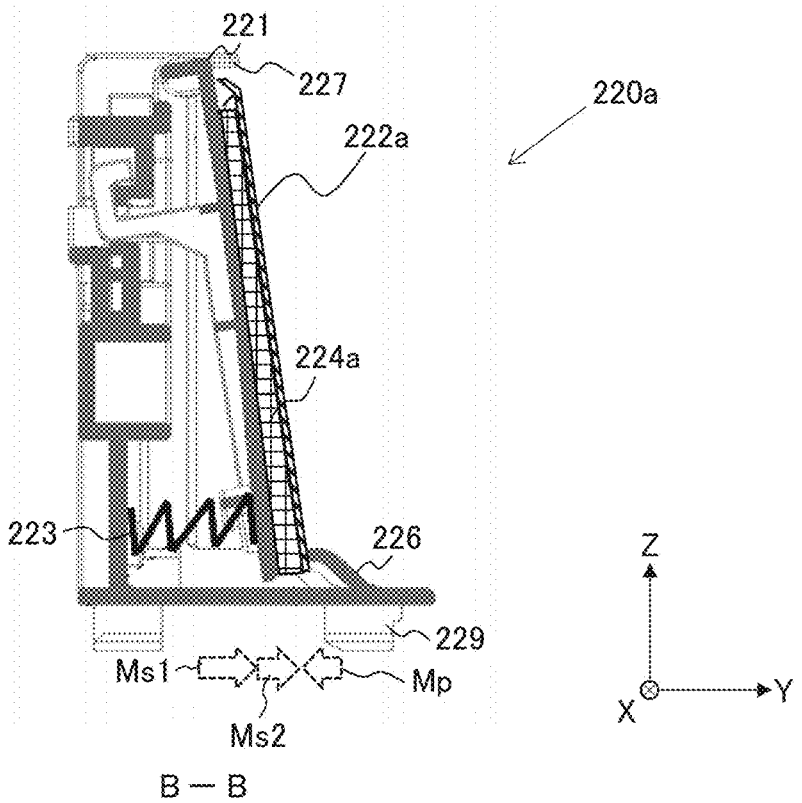
FIG. 6B is a cross-sectional view of the end fence along a B-B line illustrated in FIG. 6A.
Figure 7A:
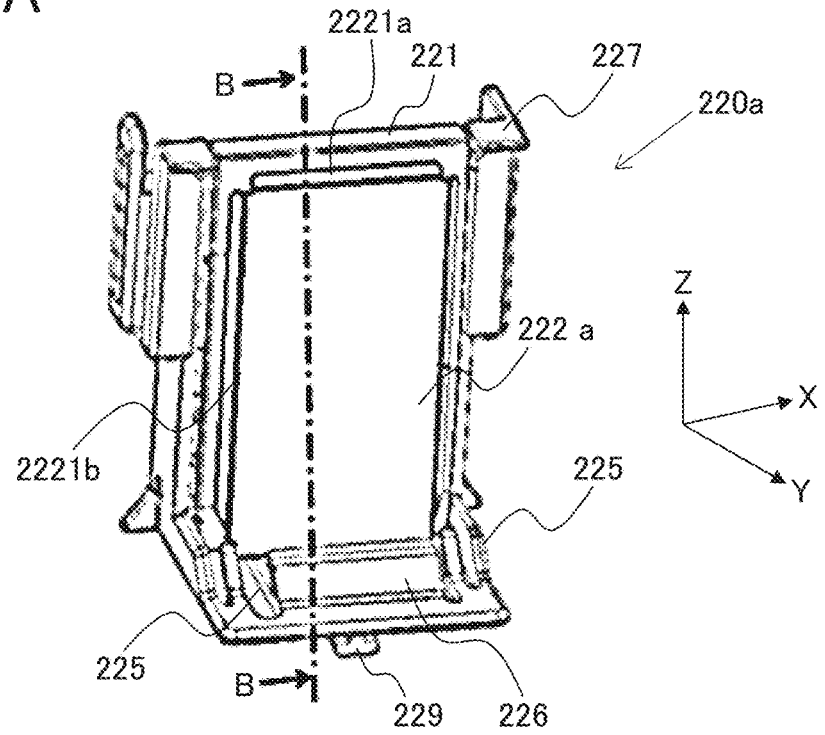
FIG. 7A is a perspective view of the end fence of FIG. 5A with sheets stacked in hill.
Figure 7B:
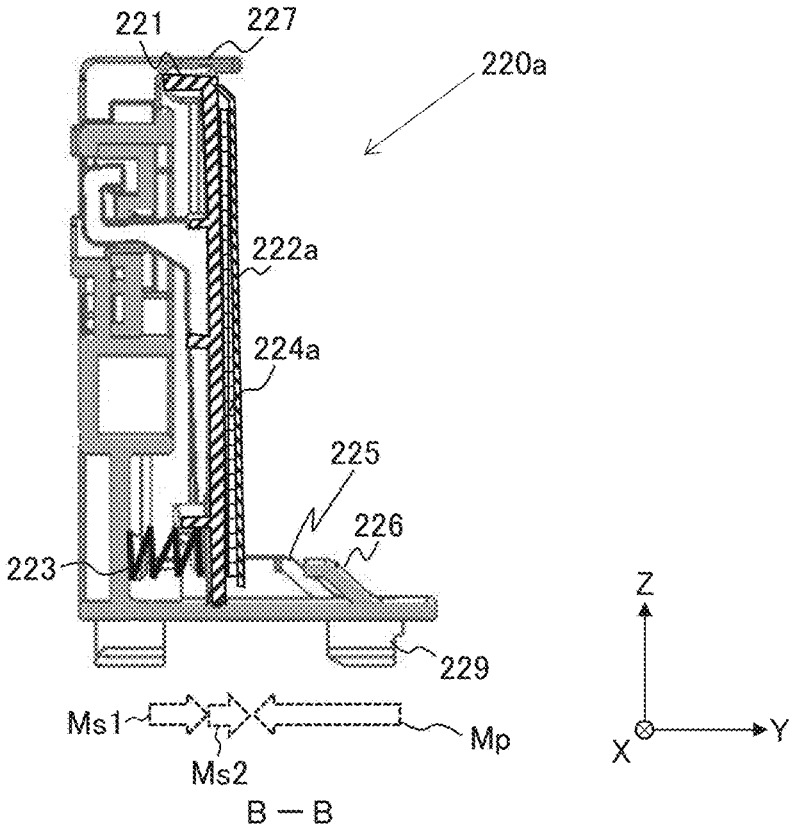
FIG. 7B is a cross-sectional of the end fence along a B-B line illustrated in FIG. 7A.

FIGS. 6A and 6B illustrate the end fence 220*a* when a relatively small amount of the sheet bundle Pb remains in the sheet storage space 210. On the other hand, FIGS. 7A and 7B illustrate the end fence 220*a* when the sheet bundle Pb is stacked in full.

In the following description, a detailed description of a configuration and functions of the end fence 220*a* like the configuration and functions of the end fence 220 of the first embodiment is omitted unless otherwise required. A description is now given of a configuration presenting features of the second embodiment.

The end fence 220*a* is disposed proximate to at the trailing end of the sheet storage space 210. The position of the end fence 220*a* is changeable relative to the bottom plate 230 according to the size of the sheet P and secured relatively to the bottom plate 230. The end fence 220*a* that is secured to the bottom plate 230 presses and supports the trailing end of the sheet bundle Pb stored in the sheet storage space 210 while keeping urging the sheet bundle Pb in the sheet conveying direction. Such a configuration allows the end fence 220*a* to prevent the leading end portion of the sheet bundle Pb from being shifted backward in the sheet conveying direction when the inclination of the bottom plate 230 increases sharply as the sheets P are continuously sent out and the remaining amount of the sheet bundle Pb decreases.

Referring now to FIGS. 6A and 6B, a description is given of a configuration of the end fence 220*a* according to the second embodiment of the present disclosure.

The end fence 220*a* includes the first support plate 221 and a second support plate 222*a* serving as end supports. Like the first support plate 221 of the first embodiment, the first support plate 221 of the second embodiment has a first end portion fixed to the upper end portion of the end fence body 227 and a second end portion rotatable about the first end portion. Thus, the first support plate 221 is supported by the end fence body 227.

The second support plate 222*a* has a configuration different from the configuration of the second support plate 222. That is, the second support plate 222*a* is a plate-shaped body having substantially the same height dimension as the first support plate 221. The second support plate 222*a* includes an upper end portion 2221*a* and side end portions 2221*b* as illustrated in FIG. 6A, The upper end portion 2221*a* is an extended upper end portion of the second support plate 222*a* and is inclined toward the first support plate 221. The side end portions 2221*b* are extended side portions of the second support plate 222*a* and are inclined toward the first support plate 221.

The upper end portion 2221*a* parries the trailing end portion of the sheet bundle Pb that is placed and stored in the sheet storage space 210 from above the end fence 220*a*, thus protecting the trailing end of the sheet bundle Pb from being caught by the second support plate 222*a*. Without the upper end portion 2221*a*, the trailing end of the sheet bundle Pb may be caught by an upper end of the second support plate 222*a*. As a result, the second support plate 222*a* may be come off from the first support plate 221 or may damage the sheets P. Thus, the second support plate 222*a* without the upper end portion 2221*a* may cause unfavorable situations. To prevent such unfavorable situations, the second support plate 222*a* includes the upper end portion 2221*a*. The second support plate 222*a* with the upper end portion 2221*a* prevents damages to the end fence 220*a* and to the sheets P when the sheet storage space 210 is replenished with new sheet bundle Pb.

The side end portions 2221*b* protect the sheets P from being caught by the second support plate 222*a* when the sheets P are sent out or when the sheet bundle Pb is placed in the sheet storage space 210. Without the side end portions 2221*b*, the second support plate 222*a* may have cut side ends. In this case, when the sheets P are sent out or when the sheet storage space 210 is replenished with new sheet bundle Pb, the sheets P may be caught by the cut side ends of the second support plate 222*a*. As a result, the trailing end of the sheets P may be lifted. When the trailing end portion of the sheets P is lifted, the leading end of the uppermost sheet Pt may not reach the given position of contact between the uppermost sheet Pt and the discharge roller 101 even though the end fence 220*a* urges the sheet bundle Pb toward the discharge roller 101, resulting in a discharge failure.

Side fences may be provided to regulate or adjust the position of the sheet bundle Pb in the width direction of the sheet bundle Pb in the sheet storage space 210. When the position of the sheet bundle Pb is adjusted while being shifted in the width direction of the sheet bundle Pb, the trailing end portion of the sheet bundle Pb may hit the side ends or side end portions of the second support plate 222*a*.

Without the side end portions 2221*b*, the second support plate 222*a* may not perry the sheet bundle Pb. As a result, the second support plate 222*a* may be come off from the first support plate 221 or may damage the sheets P. Thus, the second support plate 222*a* without the side end portions 2221*b* may cause unfavorable situations.

The lower end portion of each of the side end portions 2221*b* is inclined toward the first support plate 221. With such an inclined lower end portion, the side end portions 2221*b* prevent the sheet bundle Pb that remains by a decreased amount from being caught by the side end portions 2221*b*. In addition, when the sheet storage space 210 is replenished with a relatively small amount of sheet bundle Pb instead of a full amount of the sheet bundle Pb, each of the side end portions 2221*b* having an inclined lower end portion prevents, e.g., the lowermost sheet P of the sheet bundle Pb from being sandwiched between the lower end portion of the side end portion 2221*b* and the first stopper 225. If the lowermost sheet P of the sheet bundle Pb is sandwiched between the lower end portion of the side end portion 2221*b* and the first stopper 225, the sheet P is to be pulled out with a small pull-out force. If the force of the discharge roller 101 to send out the sheet P is weaker than the pull-out force, the discharge roller 101 may fail to send out the sheet P.

To prevent such unfavorable situations, the second support plate 222*a* includes the side end portions 2221*b* having an inclined lower end portion. The second support plate 222*a* with the side end portions 2221*b* prevents damages to the end fence 220*a* and to the sheets P when the sheet storage space 210 is replenished with new sheet bundle Pb. In addition, the second support plate 222*a* with the side end portions 2221*b* prevents a discharge failure that may be caused by the sheet P sandwiched between the second support plate 222*a* and the first stoppers 225.

At the lower end portion of the first support plate 221 is the first elastic body 223 serving as a first urging body having a first end portion attached to the end fence body 227 and a second end portion attached to the lower end portion of the first support plate 221 in FIG. 6B. The elastic force of the first elastic body 223 urges the first support plate 221 in the Y direction in FIG. 6B. In other words, the first support plate 221 is urged in a direction to press and support the sheet bundle Pb toward the position of the discharge roller 101. When the trailing end of the sheet bundle Pb contacts the first support plate 221, the uppermost sheet Pt remains at the position of contact between the uppermost sheet Pt and the discharge roller 101.

A second elastic body 224*a* serving as a second urging body is disposed on the back side of the second support plate 222*a*, between the second support plate 222*a* and the first support plate 221. The second elastic body 224*a* is a plate-shaped body made of any one of rubber, sponge, and other elastic materials and having a given thickness.

The second elastic body 224*a* exerts a second urging force to urge the second support plate 222 in the Y direction in FIGS. 6A and 6B. The second elastic body 224*a* uniformly urges the second support plate 222*a* as a whole in the Y direction in FIGS. 6A and 6B. When the trailing end of the sheet bundle Pb that remains by a decreased amount is in contact with the second support plate 222*a*, the second elastic body 224*a* applies the second urging force to the sheet bundle Pb so that the uppermost sheet Pt is pressed against the discharge roller 101 at the position of contact between the uppermost sheet Pt and the discharge roller 101.

When the sheet bundle Pb is stacked in full, the second elastic body 224*a* of the end fence 220*a* is crushed and thinned as illustrated in FIG. 7B. At this time, the second support plate 222*a* is closest to the first support plate 221. As the sheet P is sent out from the state illustrated in FIGS. 7A and 7B and the remaining amount of the sheet bundle Pb decreases, the trailing end pressure contact force Mp decreases. Accordingly, the first urging force Ms1 rotates the lower end portion of the first support plate 221 in the Y direction. As the remaining amount of the sheet bundle Pb further decreases after the first stoppers 225 restrict the rotation of the first support plate 221, the second urging force Ms2 moves the second support plate 222*a* in the Y direction in FIGS. 7A and 7B.

As described above, the end fence 220*a* according to the second embodiment includes the first support plate 221 and the second support plate 222*a* to urge the sheet bundle Pb in the sheet conveying direction while changing the urging forces in stages, according to the remaining amount of the sheet bundle Pb in the sheet storage space 210. In other words, according to the degree of decrease in the remaining amount of the sheet bundle Pb, the end fence 220*a* holds the uppermost sheet Pt at the position of contact between the uppermost sheet Pt and the discharge roller 101 while changing in stages the support plates to support the trailing end portion of the sheet bundle Pb, specifically, with the first support plate 221 and then with the second support plate 222*a*.

In such a configuration, the first urging force urges the sheet bundle Pb that remains by a relatively large amount until the remaining amount of the sheet bundle Pb decreases and the inclination of the bottom plate 230 increases. When the remaining amount of the sheet bundle Pb decreases and the inclination of the bottom plate 230 increases, the first urging force and the second urging force urge the sheet bundle Pb that remains by a relatively small amount to regulate the trailing end of the sheet bundle Pb at a given position.

In other words, even in a case in which the height dimension of the first support plate 221 is reduced to downsize the end fence 220*a* without increasing the moving amount of the first support plate 221 exerting the first urging force, the first support plate 221 cooperates with the second support plate 222*a* to regulate the position of the trailing end of the sheet bundle Pb at the given position.

The embodiments of the present disclosure can be applied to, e.g., a sheet feeding device including an input tray, a sheet feeding device including a bypass feeder, or a sheet feeding device including a document input tray incorporated in, e.g., a copier.

According to the embodiments described above, even in a small-sized sheet feeding device, a discharge roller keeps in contact with a sheet from when the sheet feeding device is loaded in full with sheets until when the last sheet is discharged, thus preventing a discharge failure.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A sheet feeding device comprising:

a storage configured to store a sheet bundle;

a discharger configured to contact and discharge an uppermost sheet of the sheet bundle from the storage in a sheet conveying direction in which the uppermost sheet is conveyed; and an end fence configured to urge a trailing end of the uppermost sheet in the sheet conveying direction toward the discharger in stages according to a remaining amount of the sheet bundle in the storage, wherein the end fence is further configured to urge and support the bundle in the sheet conveying direction, and the end fence includes, an end support configured to support an end portion of the sheet bundle, a first spring configured to urge the end support in the sheet conveying direction, and a second spring configured to urge the end support in the sheet conveying direction, and the second spring has an urging force weaker than an urging force of the first spring.

2. The sheet feeding device according to claim 1, further comprising:

an angle adjusting device configured to change an angle of inclination of the uppermost sheet; and wherein the discharger is a roller.

3. The sheet feeding device according to claim 1, further comprising:

an angle adjusting device including, a bottom plate as a bottom of the storage, and a bottom plate mover configured to vertically move the bottom plate, the bottom plate mover being an elastic body configured to move one end portion of the bottom plate, and the angle adjusting device is further configured to change an angle of the bottom plate according to the remaining amount of the of the sheet bundle in the storage.

4. The sheet feeding device according to claim 1, wherein the end support is configured to urge the sheet bundle with the first spring and the second spring in response to the storage being loaded in full with the sheet bundle; and the end support is configured to urge the sheet bundle with the second spring in response to a decrease in amount of the sheet bundle in the storage.

5. The sheet feeding device according to claim 1, wherein the end support is configured to urge the sheet bundle with the second spring after a desired position where the end support stops further urging of the sheet bundle with the first spring.

6. The sheet feeding device according to claim 1, wherein the end support includes:

a first support configured to urge the sheet bundle with the first spring; and a second support configured to urge the sheet bundle with the second spring.

7. The sheet feeding device according to claim 6, wherein the end fence includes an end fence body;

the first support has an upper end portion held by the end fence body and a lower end portion rotatable about the upper end portion and provided with the first spring; and second support has a first end portion held by the first support and a second end portion rotatable about the first end portion and provided with the second spring.

8. The sheet feeding device according to claim 6, wherein the end fence includes an end fence body;

first support has an upper end portion held by the end fence body and a lower end portion rotatable about the upper end portion and provided with the first spring; and the second spring is on the first support and the second support.

9. The sheet feeding device according to claim 6, further comprising:

a first stopper configured to restrict, at a given position, movement of the first support toward the discharger; and a second stopper configured to restrict, at a given position, movement of the second support toward the discharger, and the second stopper is located closer to the discharger than the first stopper.

10. The sheet feeding device according to claim 9, wherein the first stopper is configured to contact the first support at a position above a lower end portion of the first support; and the second stopper is configured to contact the second support at a position above a lower end portion of the second support.

11. The sheet feeding device according to claim 1, wherein the first spring and the second spring are elastic bodies.

12. An image forming apparatus comprising:

a sheet feeding device configured to feed at least one sheet;

a conveying device configured to convey the at least one sheet fed from the sheet feeding device; and an image forming device configured to form an image on the at least one sheet conveyed by the conveying device, wherein the sheet feeding device includes, a storage configured to store a sheet bundle;

a discharger configured to contact and discharge an uppermost sheet of the sheet bundle from the storage in a sheet conveying direction in which the uppermost sheet is conveyed; and an end fence configured to urge a trailing end of the uppermost sheet in the sheet conveying direction toward the discharger in stages according to a remaining amount of the sheet bundle in the storage, wherein the end fence is further configured to urge and support the sheet bundle in the sheet conveying direction, and the end fence includes, an end support configured to support an end portion of the sheet bundle, a first spring configured to urge the end support in the sheet conveying direction, and a second spring configured to urge the end support in the sheet conveying direction, and the second spring has an urging force weaker than an urging force of the first spring.

13. The image forming apparatus according to claim 12, further comprising:

an angle adjusting device configured to change an angle of the sheet bundle.

14. The image forming apparatus according to claim 13, wherein the angle adjusting device further includes:

a bottom plate as a bottom of the storage; and a bottom plate mover configured to vertically move the bottom plate.

15. The image forming apparatus according to claim 13, wherein the angle adjusting device is further configured to:

press a leading end portion of the uppermost sheet against the discharger.

16. The image forming apparatus according to claim 12, wherein the end support is configured to urge the sheet bundle with the first spring and the second spring in response to the storage being loaded in full with the sheet bundle; and the end support is configured to urge the sheet bundle with the second spring in response to a decrease in amount of the sheet bundle in the storage.

17. The image forming apparatus according to claim 12, wherein the end support is configured to urge the sheet bundle with the second spring after a desired position where the end support stops further urging of the sheet bundle with the first spring.

18. The image forming apparatus according to claim 12, further comprising:

a first stopper configured to restrict, at a given position, movement of the first spring toward the discharger; and a second stopper configured to restrict, at a given position, movement of the second spring toward the discharger, and the second stopper is located closer to the discharger than the first stopper.

19. The image forming apparatus according to claim 18, wherein the first stopper is configured to contact the end support at a desired position above a lower end portion of the end support; and the second stopper is configured to contact the end support at a position below the first stopper.

20. A method of operating a sheet feeding device comprising:

contacting and discharging, using a discharger, an uppermost sheet of a sheet bundle from a storage in a sheet conveying direction in which the uppermost sheet is conveyed; and urging, using an end fence, a trailing end of the uppermost sheet in the sheet conveying direction toward the discharger in stages according to a remaining amount, the urging further including, urging and supporting the sheet bundle in the sheet conveying direction using the end fence, supporting an end portion of the sheet bundle using the end fence, urging an end support of the end fence in the sheet conveying direction using a first spring of the end fence, and urging the end support in the sheet conveying direction using a second spring of the end fence, the second spring having an urging force weaker than an urging force of the first spring.

* * * * *